United States Patent [19]

Berthou

[11] 4,116,038

[45] Sep. 26, 1978

[54] APPARATUS FOR SHAPING SHEET MATERIAL

[76] Inventor: Knud Vilhelm Berthou, Lystbaadeves 12, DK-4000 Roskilde, Denmark

[21] Appl. No.: 779,586

[22] Filed: Mar. 21, 1977

[30] Foreign Application Priority Data

Mar. 23, 1976 [DK] Denmark ..... 1269/76

[51] Int. Cl.[2] ..... B21D 37/10

[52] U.S. Cl. ..... 72/413; 72/478

[58] Field of Search ..... 72/414, 415, 470, 473, 72/475, 476, 478, 481, 482, 413; 76/107 R; 29/156.8 P

[56] References Cited

U.S. PATENT DOCUMENTS

| | | | |
|---|---|---|---|
| 928,353 | 7/1909 | Bissell | 72/413 |
| 1,019,073 | 3/1912 | Nazel | 72/413 |
| 2,267,774 | 12/1941 | Wall | 72/478 |
| 2,334,520 | 11/1943 | Walters | 72/413 |
| 2,679,172 | 5/1954 | Clevenger | 76/107 R |
| 2,916,074 | 12/1959 | Lorenz | 72/476 |
| 3,187,549 | 6/1965 | Guy | 72/478 |
| 3,226,969 | 1/1966 | De Jong | 72/413 |
| 3,566,642 | 3/1971 | Whitacre | 76/107 R |
| 3,640,175 | 2/1972 | Barclay | 72/476 |

FOREIGN PATENT DOCUMENTS

| | | | |
|---|---|---|---|
| 1,918,179 | 10/1970 | Fed. Rep. of Germany | 72/478 |

*Primary Examiner*—Milton S. Mehr
*Assistant Examiner*—Gene P. Crosby
*Attorney, Agent, or Firm*—Lawrence E. Laubscher

[57] ABSTRACT

Sheet material shaping apparatus is disclosed for manufacturing ship propeller blades and the like, characterized in that the sheet shaping apparatus includes top and bottom base elements between which a plurality of abutting members are arranged, each of the members having the configuration of a cylindrical sector, successive members having progressively differing heights to cause the top edges of the members to define a helicoidal shaping surface.

8 Claims, 15 Drawing Figures

APPARATUS FOR SHAPING SHEET MATERIAL

BACKGROUND OF THE INVENTION

The invention relates to an apparatus for shaping sheet material, more particularly for manufacturing of propellers for ships, said apparatus comprising a top part and a bottom part, each built up by abutting members.

Considering that ships' propellers have to be resistant to the chemical influence exerted by the sea water, bronze casting is usually applied when manufacturing such propellers. These ships' propellers are designed as a helicoid. However, due to the immense forces in question, and because of strength, the cross section of the propeller increases toward the root, and this results in a smaller pitch of the helicoid at the front surface of the propeller than at the back surface of same. Among other things, this condition is a contributory cause of reducing the efficiency of the propeller.

In order to overcome this disadvantage, it has been proposed to manufacture propellers of sheet material, for instance rustless steel plate, thereafter welding said propellers to a boss. However, the hitherto known methods of shaping such plate material have not yet been economically sound, and therefore such ships' propellers have not been greatly introduced.

Therefore, the purpose of the present invention is to provide an apparatus whereby the manufacturing of ships' propellers can be carried out at a more favorable price by reducing the costs of the apparatus to a minimum.

SUMMARY OF THE INVENTION

The apparatus according to the invention is characterized in that each member is shaped as a part of a sector of a circle resting on a plane surface, and that the top edges of said members form generatrices of a generally helicoid surface.

In a preferred embodiment, the members are juxtaposed lamellas and the thickness of each lamella varies according to the distance between the mentioned generatrices. By this, a fan-shaped positioning of the members is obtained, said members being mainly rectangular when viewed from the side, but all of different heights.

By this embodiment, the cost of the apparatus can be further reduced by using a basic element shaped as winding stairs, where all steps are of same height and length respectively, and by placing on each step a set of surface elements adapted so that a mainly continuous forming surface is obtained. Thus, it will only be necessary to produce sets of elements for each step. Naturally, the basic element need not be shaped in one piece, but may itself consist of parts shaped as circular sectors.

A further simplification of the manufacture of propellers of equal radial extension, but with different rises, may be obtained by using the same stepped basic element for all rises, while the height of the steps is adjusted be means of additional step elements.

Finally, a basic element may also be used the top surface of which has the desired helicoid form, and on this surface equally high elements are placed, and in this case the basic element need only consist of an outer and an inner cylindrical wall element, between which wall elements the surface elements are placed.

In another embodiment of the apparatus according to the invention, the elements are sheet-formed circular sectors of at least 90°, which elements are placed on top of each other, each element being displaced a small angle in relation to the previous or underlying element, as the axial extension can be regulated by the number of elements or the thickness of plate. By this, the apparatus can be produced of uniform elements.

In this embodiment each element is provided with at least one circular cut from the edge of the element that does not form part of the surface of the apparatus. By this, a simple assembling of the elements by means of bolts is made possible.

When manufacturing larger ships' propellers which out of consideration of strength may require propellers assembled by a front part and a rear part, the edges of the elements being part of the forming surface may be more or less curved inwards or concave on the one die and correspondingly curved outwards or convex on the other die.

BRIEF DESCRIPTION OF THE FIGURES

The invention is further described in the following by means of examples and referring to the accompanying drawings, in which.

DETAILED DESCRIPTION

Figure 1:
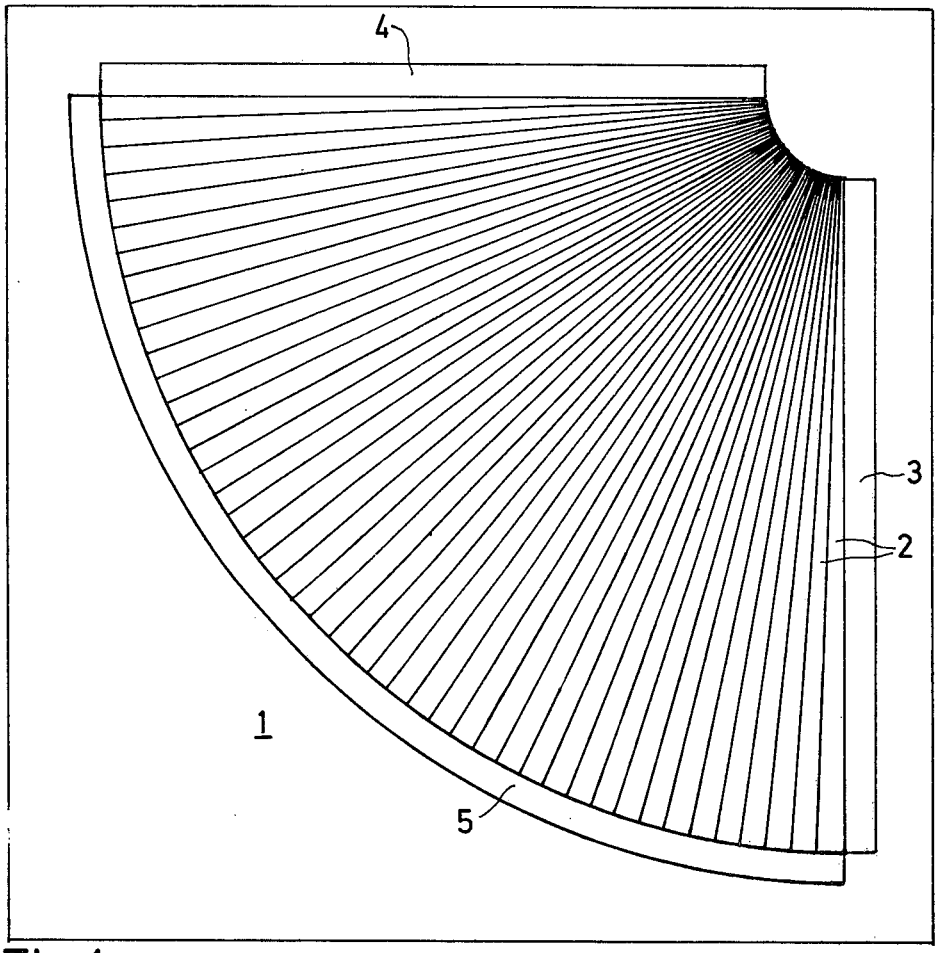
FIG. 1 shows an apparatus according to the invention, schematically viewed from the top.
Figure 2:
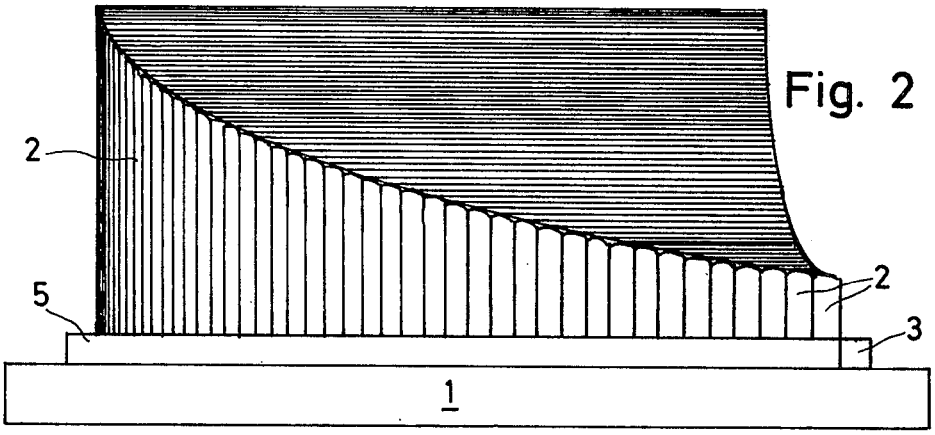
FIG. 2 is a side view of the apparatus of FIG. 1.

In FIGS. 1 and 2, the one part of an apparatus according to the invention is seen, for example, the bottom part, and the top part is designed in the same way, but reversed. The apparatus is intended for manufacturing a helicoid surface of 90°.

Figure 3:
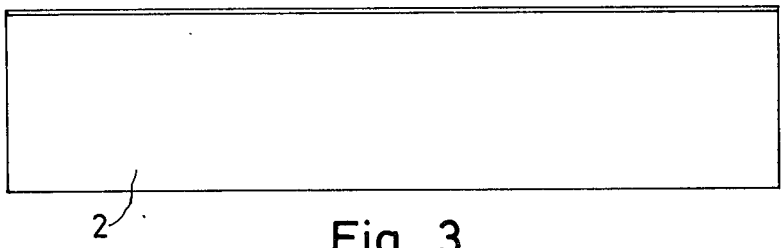
FIG. 3 is a side view of one of the elements of the forming surface of the apparatus of FIG. 1.
Figure 4:
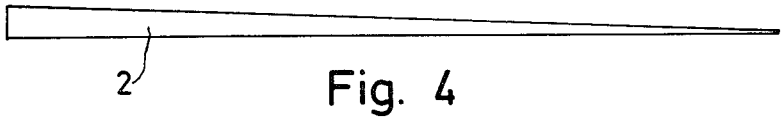
FIG. 4 is the element of FIG. 3, viewed from the top.

The apparatus comprises a base 1, whereon elements 2 are placed, each covering a circular sector of 2°. The elements 2 are all of different heights and are placed close side by side according to increasing height, and they are kept together by guide bars 3 and 4 and a guide arc 5. One of the elements 2 is shown in FIGS. 3 and 4.

Figure 5:
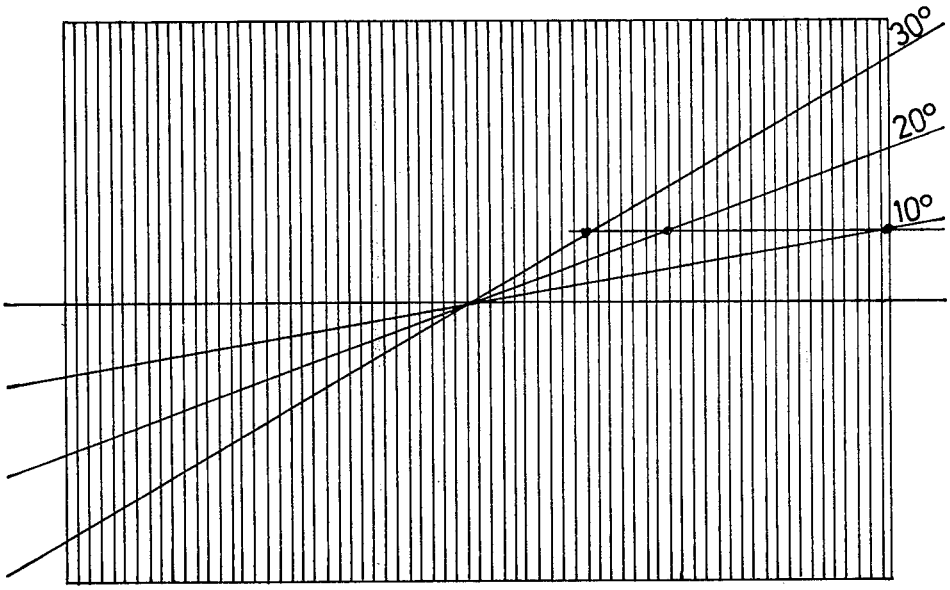
FIG. 5 is a graph for determining the height of the element.

The increase of height from the one element to the next one is the same and dependent on the rise itself of the helicoid surface in question. It is shown in FIG. 5 how the height of the individual elements may be determined. This figure should be understood as the outside circular cylindrical surface unfolded, and various rises of the helicoid surface are drawn in.

The height of the lowest element is determined, and thereafter the height of the other elements can be measured from a horizontal base line, extending from the foot of the lowest element.

As the individual elements of the embodiment shown in FIGS. 1 and 2 each covers a circular sector of 2°, 45 elements are used for a surface of 90°, and for a surface of 120°, 60 elements are used.

Figure 6:
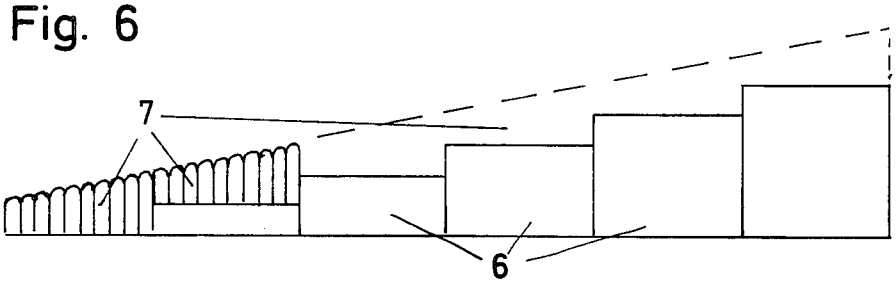
FIG. 6 is another embodiment of the apparatus according to the invention, viewed in an unfolded state.

The number of different elements may be reduced by using an infilling panel, as shown in FIG. 6. It is here shown, how the manufacturing of the apparatus can be rationalized by an element 6 shaped as winding stairs. For each step the height and the length respectively are the same, so that the same set of elements can be placed on each step.

The length of the step is calculated to hold ten elements, and the height of the step is such that the lowest element on a step extends above the highest element of the previous step corresponding to the increase between two adjacent elements. Thereby, for instance, 6 sets of surface elements 7 with the same element sizes in each set may be produced.

Obviously, different stepped elements have to be produced for different rises of the helicoid surface.

Figure 7:
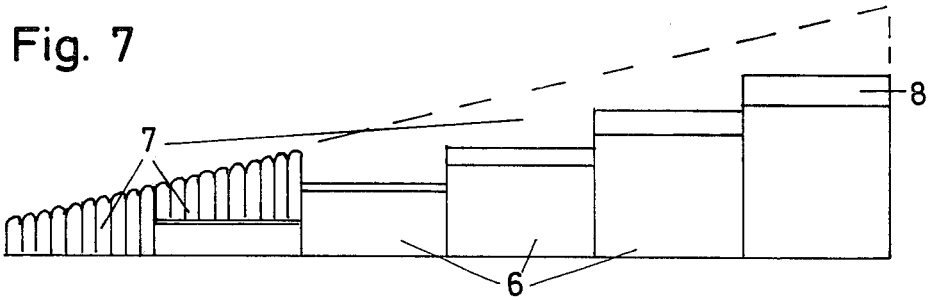
FIG. 7 is still another embodiment of the apparatus according to the invention.

However, the manufacturing of apparatus having different rises can be further simplified by using the same stepped basic element 6, as shown in FIG. 7, as the difference in rise from step to step may be equalized by additional step elements 8 placed on each step. These step elements in their entire extension are of the same height.

In the table below, the elements are stated which in addition to the stepped base element 6 are to be used for seven different rises of a propeller of a screw propeller for a ship with three propellers of 120°, where a total of 60 surface elements of 2° have to be used for both the top part and the bottom part of the apparatus.

| | Height of elements in mm | |
|---|---|---|
| Rise in inches | Additional elements (8) | Surface elements (7) |
| 10.5 | — | 16 - 17.5 - 19 - 20.5 - 22 - 23.5 - 25 - 26.5 - 28 - 29.5 |
| 12 | 2.5 - 5 - 7.5 - 10 - 12.5 | 16 - 17.75 - 19.5 - 21.25 - 23 - 24.75 - 26.5 - 28.25 - 30.0 - 31.75 |
| 14 | 5 - 10 - 15 - 20 - 25 | 16 - 18 - 20 - 22 - 24 - 26 - 28 - 30 - 32 - 34 |
| 16 | 7.5 - 15 - 22.5 - 30 - 37.5 | 16 - 18.25 - 20.5 - 22.75 - 25 - 25.75 - 29.5 - 31.75 - 34 - 36.25 |
| 17.5 | 10 - 20 - 30 - 40 - 50 | 16 - 18.5 - 21 - 23.5 - 26 - 28.5 - 31 - 33.5 - 36 - 38.5 |
| 19.5 | 12.5 - 25 - 37.5 - 50 - 62.5 | 16 - 18.75 - 21.5 - 24.25 - 27 - 29.75 - 32.5 - 35.25 - 38 - 40.75 |
| 21 | 15 - 30 - 45 - 60 - 75 | 16 - 19 - > - 25 - 28 - 31 - 34 - 37 - 40 - 43 |

Figure 8:
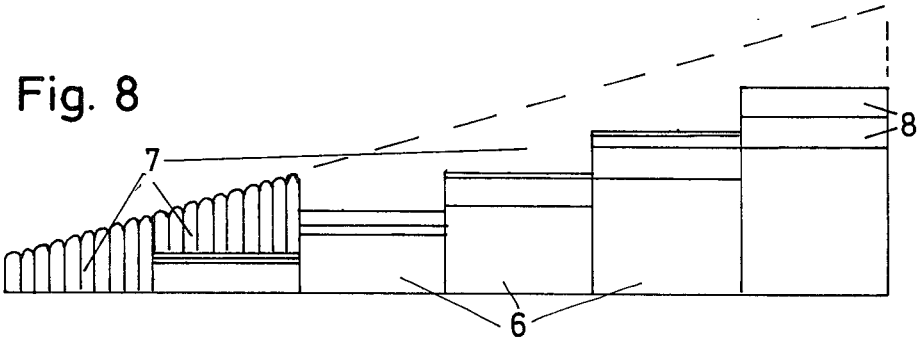
FIG. 8 is the same as FIG. 7, but with additional step elements for achieving an increased rise.

The examples shown in FIGS. 6, 7 and 8 are 10.5 inches, 14 inches and 16 inches respectively in this table. The table shows that it is unnecessary to use all of the seven times five additional elements, as, for instance, the additional elements of 12 inches and 14 inches can be put together and form step elements for 16 inches, such as it is shown in FIG. 8. It can be shown that the total 35 step rises can be covered by a total of twelve different step elements.

Figure 9:
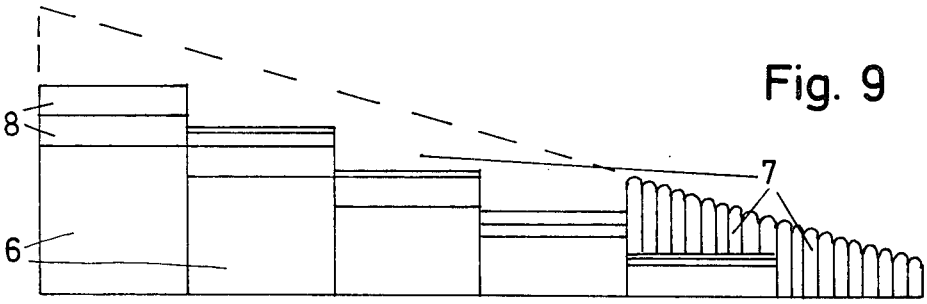
FIG. 9 is the same as FIG. 8, but with opposite direction of turn of the helicoid surface.

In FIG. 9 it is shown how the elements by reversal of the order of FIG. 8 easily may be changed for producing a helicoid surface with opposite turn.

Figure 10:
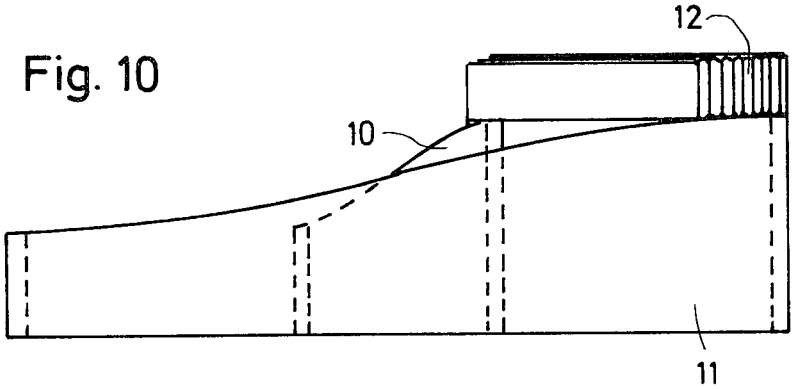
FIG. 10 is still another embodiment of the apparatus according to the invention, side view.
Figure 11:
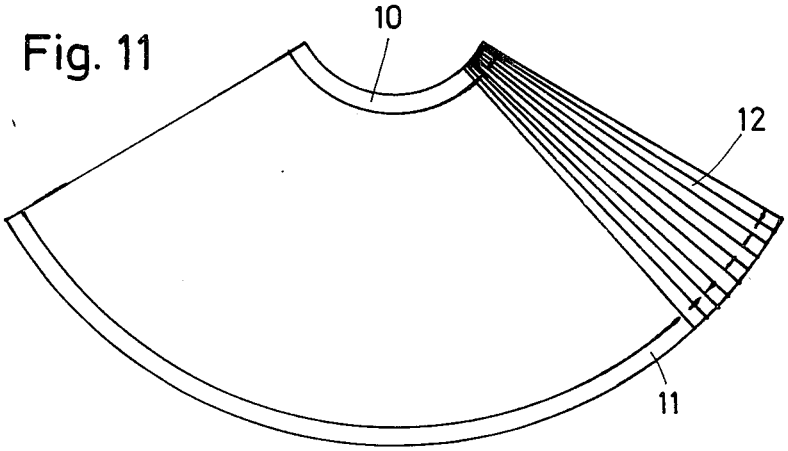
FIG. 11 is the apparatus of FIG. 10, seen from the top.

In FIGS. 10 and 11 an embodiment is shown, where the base element comprises two cylindrical wall elements 10 and 11, the end edges of which in pairs are equally high, and the top edges of which follow the inner and outer screw lines respectively of the helicoid surface. Between the two wall parts, a number of uniform elements 12 are placed, which form the forming surface of the apparatus.

The embodiments shown above, all have in common that the elements are lamellas placed side by side in a fan-shape. However, the elements may also be manufactured as sheet-formed circular sectors, as shown in FIGS. 12 to 15.

Figure 12:
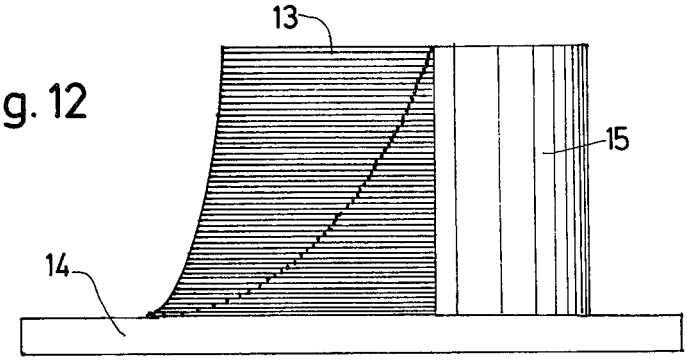
FIG. 12 is still another embodiment of the apparatus according to the invention, side view.
Figure 13:
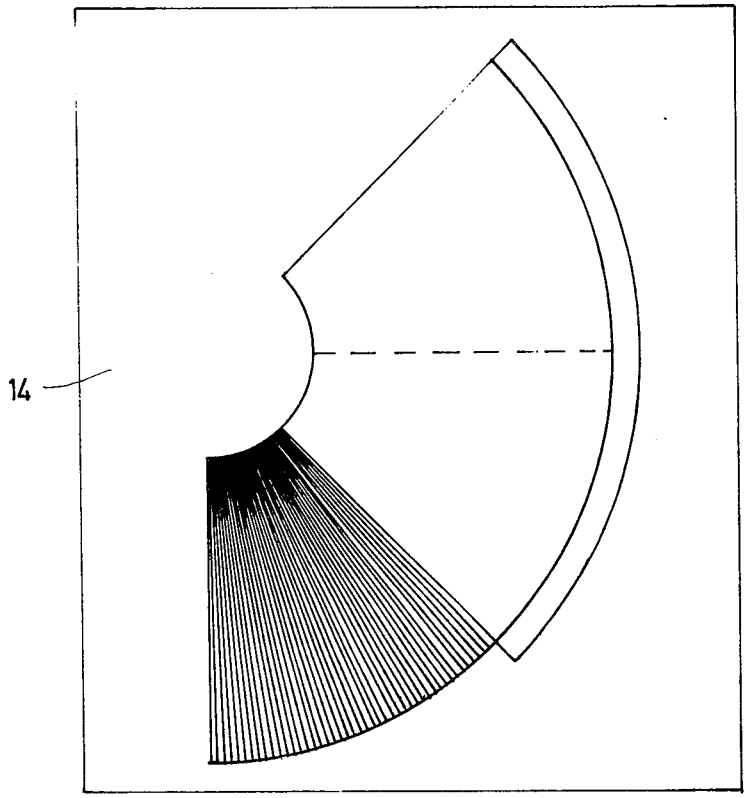
FIG. 13 is the apparatus of FIG. 12, seen from the top.
Figure 14:
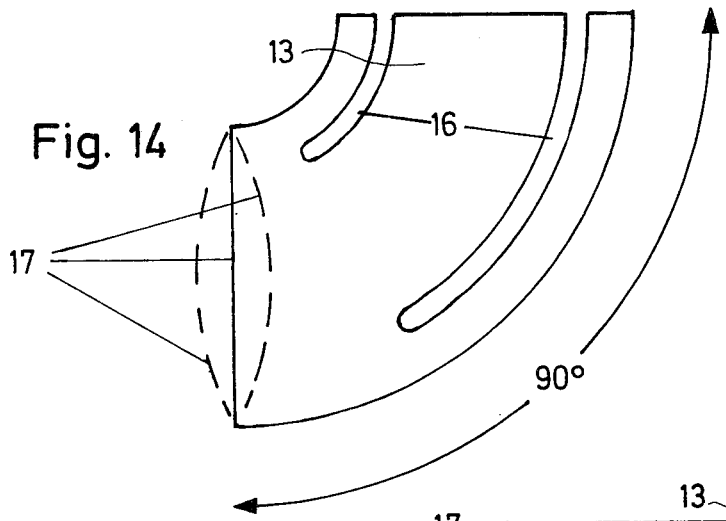
FIG. 14 is an element of the apparatus of FIG. 12, seen from the top, in plan view
Figure 15:
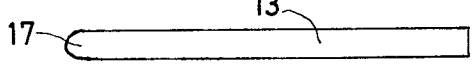
FIG. 15 is the element of FIG. 14, side view.

In FIGS. 12 and 13, such sheet elements 13 are shown, which all are identical and placed on top of each other on a base plate 14, each element being turned a small angle in relation to the underlying element. A supporting wall 15 is shaped as part of a cylinder. In FIGS. 14 and 15, an individual sheet element 13 is shown, which in this case is provided with two cuts 16 for securing the sheet elements to the base plate 14. The sheet element 13 is a circular sector of preferably 90°, but may cover a larger circular sector dependent on the size of the forming surface, or the sheet elements may possibly decrease in size in upward direction.

In FIG. 14, it is shown that the edge 17 of the sheet element 13 being part of the forming surface may be rectilinear or, as indicated by dotted lines, shown in plan view may curve outwards or inwards with the edges of the elements of the opposing die curving in the opposite direction.

This edge 17 is preferably rounded, as shown in FIG. 15, so that no sharp edges may put marks in the sheet material in question.

The height of the apparatus may be regulated by the number of elements by using elements of another thickness.

I claim:

1. Apparatus for manufacturing a ship propeller, comprising upper and lower cooperating shaping means each including (a) a base member; and (b) a plurality of contiguous surface forming elements mounted on said base member, each of said elements having the configuration of the sector of a cylinder, the heights of successive elements being progressively graduated to cause the upper surfaces of said elements to define a helicoidal shaping surface

2. Apparatus as defined in claim 1, wherein the upper surface of said base member is stepped to define a generally winding staircase configuration the steps of which are identical, sets of said surface forming elements of the same number, size and configuration being mounted on said steps, respectively.

3. Apparatus for manufacturing a ship propeller, comprising upper and lower cooperative shaping means each including (a) a base member;

(b) a plurality of contiguous surface forming elements mounted on said base member, each of said elements having the configuration of the sector of a cylinder, the heights of successive elements being progressively graduated to cause the upper surfaces of the elements to define a helicoidal shaping surface;

(c) said base member being stepped to define generally a winding staircase configuration the steps of which are identical, sets of said surface forming elements of the same size, number and configuration being mounted on said steps, respectively; and (d) means for varying the heights of said steps to adjust the pitch of said helicoidal surface.

4. Apparatus for manufacturing a ship propeller, comprising upper and lower cooperating shaping means each including (a) a base member comprising a pair of concentric cylindrical wall elements, the upper edges of which define the inner and outer sector lines of a helicoid, respectively, and (b) a plurality of contiguous surface forming elements mounted on said base member, each of said elements having the configuration of the sector of a cylinder and being of equal height whereby the upper surfaces of said elements define a helicoidal shaping surface.

5. Apparatus for manufacturing a ship propeller, comprising upper and lower cooperating shaping means each including (a) a base member; and (b) a plurality of contiguous surface forming elements mounted on said base member, each of said elements having the configuration of a planar circular section of at least 90°, said elements being stacked on one another, each element being displaced by a small relative to the previous element to cause the displaced edges of said elements to define a helicoidal shaping surface.

6. Apparatus as defined in claim 5, wherein each of said elements contains at least one circular cut extending from an edge remote to that of the surface forming edge of said element.

7. Apparatus as defined in claim 5, wherein the surface forming edge of each of said elements is rectilinear.

8. Apparatus as defined in claim 5 wherein the surface forming edges of said members associated with one of said top and bottom elements are curved inwardly, and the surface forming edges of said members associated with the remaining element are curved outwardly.

* * * * *